US005665007A

United States Patent [19]

Tatum

[11] Patent Number: 5,665,007

[45] Date of Patent: Sep. 9, 1997

[54] GOLF PUTTING TRAINING DEVICE

[76] Inventor: Eugene T. Tatum, 1617 Euclid Ave., Bowling Green, Ky. 42103

[21] Appl. No.: 595,279

[22] Filed: Feb. 1, 1996

[51] Int. Cl.[6] ..... A63B 69/36

[52] U.S. Cl. ..... 473/238; 473/257

[58] Field of Search ..... 473/228, 238, 473/241, 251, 252, 253, 254, 255, 268, 257

[56] References Cited

U.S. PATENT DOCUMENTS

| | | | |
|---|---|---|---|
| 3,033,574 | 5/1962 | Partridge . | |
| 3,058,392 | 10/1962 | Primeau . | |
| 3,253,829 | 5/1966 | Ford | 473/238 |
| 3,262,705 | 7/1966 | Nunziato . | |
| 3,273,892 | 9/1966 | Nolting . | |
| 3,273,893 | 9/1966 | Duncan . | |
| 3,298,693 | 1/1967 | Eisenberg . | |
| 3,495,834 | 2/1970 | Tanczos . | |
| 3,565,444 | 2/1971 | La Rocca | 473/228 |
| 3,951,415 | 4/1976 | Stuart . | |
| 4,053,160 | 10/1977 | Salata . | |
| 4,167,268 | 9/1979 | Lorang . | |
| 4,174,838 | 11/1979 | Paschetto . | |
| 4,647,045 | 3/1987 | Bilyeu . | |
| 4,789,158 | 12/1988 | Chiesa . | |
| 4,949,971 | 8/1990 | Thornton . | |
| 4,953,867 | 9/1990 | Rigsby . | |
| 5,143,376 | 9/1992 | Johnson | 473/228 |
| 5,156,401 | 10/1992 | Hodgkiss . | |
| 5,310,188 | 5/1994 | Hernberg | 473/228 |

*Primary Examiner*—George J. Marlo
*Attorney, Agent, or Firm*—Wheat, Camoriano, Smith & Beres, PLC

[57] ABSTRACT

A golf putting training device (22) attached to the shaft (30) of a putter (14) has a shape that extends out from the shaft (30) and forms an elongated edge (24) that is aligned by a user (10) along the heel (**16*b*) of the putter (14) so that a spacing (38) is formed between the edge (24) and a golf ball (12) adjacent the putter head face (16*a*) at address. The user (10) moves the putter head (16) along the putting stroke so that the spacing (38) is maintained essential constant throughout the stroke thereby ensuring the putter head face (16*a*) is maintained perpendicular to the target line (36**) during the putting stroke.

15 Claims, 5 Drawing Sheets

GOLF PUTTING TRAINING DEVICE

BACKGROUND OF THE INVENTION

This invention relates to a device assisting in the development of a consistent putting stroke and, more particularly, to a device that permits a user to develop a feel of a proper putting stroke while visually confirming that the face of a putter head remains essentially normal to the intended golf ball putting path during such a stroke.

Although the concept of putting is fairly simple, the proper putting technique is difficult to master and maintain. The concept of putting a ball requires that the face of the putter head be essentially normal to the line extending through the ball in the direction that the golfer wishes to stroke the ball (the "target line") and that the face impact the ball while the putter head moves along this line. A good putting stroke first requires a proper address position. At address, the sole of the putter is placed in substantially abutting relationship with the putting surface and face of the putter is placed immediately behind the ball, in essentially an abutting relationship, with the face centered on the ball and normal to the target line. The putter head is then moved a short distance back from the ball while maintaining the face normal to the target line and centered on the ball (the "back swing"). Next, the putter head is propelled forward to impact the ball while still maintaining the normal and centered relationship of the face (the "approach") and then maintained in the same relationship for a short distance after impact (the "follow through").

Simple in concept, but extremely difficult in the implementation, the desired putting stroke has been analyzed endlessly. The most widely accepted technique to implement the proper putting stroke is the use of the pendulum swing technique where the golfer maintains firm wrists (i.e., does not break his or her wrists) and swings essentially from the shoulders. The putter swings in an arc much like a pendulum, the shoulders of the golfer being the pivot of the pendulum shaft and the arms and putter shaft being the pendulum shaft. When performed correctly, this technique provides a consistent approach of the face to the ball. The correct technique requires that the face be initially aligned correctly. Next the putter head is moved along the extension of the target line in the back swing and then moved forward along the target line in approach and follow through. Upon impact, the golf ball will then move along the target line.

The errors that arise in putting are numerous and can occur during the address, the back swing, or the approach to the point of impact. The results of the errors are typically similar, i.e., the ball moves along an undesired path. Only a fraction of a degree deviation of the putter face from normal to the target line may result in missed putts, particularly at putting distances greater than about four to five feet. Correcting such putting errors requires much practice to develop the proper technique and feel of putting. Too often the proper technique and feel is thought to have been developed when, in fact, one error is corrected by introducing another, resulting in the compounding of errors and inconsistent play. It clearly would be desirable to have a putting aid that would allow the golfer to actually visualize whether the proper putting stroke is occurring. Connecting a proper visual image to the "feel" reinforces the proper feel which is more likely to be carried over into actual golf games quicker and with more consistency than the trial and error method of usual practice.

The number of devices that have been created to develop and improve the putting skill of golfers are legion. The patent art, for example, is replete with devices that are meant to aid the golfer in his or her quest for improved putting, perhaps the most crucial aspect of scoring in golf. However, when searching the availability of such putting devices commercially, it is noted that very few are being marketed. This can perhaps be attributed to the complexity of many of the prior art devices, which deters the average golfer from using them but once. Golfers have little patience for devices requiring more than a few seconds of set up time and/or extensive practice to use them correctly. Moreover, many putting devices, due to their cumbersome nature, prevent a golfer from developing a feel for putting which can be carried over to actual play.

U.S. Pat. No. 3,951,415 issued Apr. 20, 1976 to W. H. Stuart describes a simple putting aid device which clamps to the shaft of the putter and assists the golfer in aligning the putter head with the face normal to the target line at address. The device of the Stuart patent, however, does not provide for visual confirmation that the normal alignment of the face of the putter head is being maintained during the back swing and approach.

Still another simple putting aid device, alerting the user when the putter head is not properly aligned at address, is found in U.S. Pat. No. 4,367,268 issued Sep. 11, 1979 to Lorang. The device utilizes a gauge that is preferably in the form of an open circle mounted on the shaft of the putter. The golfer views the ball and the putter head through the gauge and from this can determine if the putter face is aligned normally to the projected path of the ball. The patentee further states in one of the objects that the gauge can be used to visually indicate whether or not the club head has been moved on a straight line during the stroke. Unfortunately, it appears that the golfer would have to watch the gauge instead of the ball during the back swing and approach rather than the ball itself. This in itself is a grave error, as it is extremely important for the golfer to keep his or her eyes on the ball at all times. Other visual aligning devices are found variously in U.S. Pat. Nos. 3,033,574; 3,262,705; 3,273,892; 3,273,893; 3,298,693; 3,495,834; 4,174,838; 4,647,045; 4,789,158; 4,949,971; and 4,953,867.

U.S. Pat. No. 4,053,160 issued Oct. 11, 1977 to Salata is typical of the devices that utilize image projections to aid the golfer in aligning the club face at address and for indicating alignment has been maintained through the club swing. It is a complex device to use and would largely deter any but the most dedicated golfer with a bent toward using complex gadgets for practicing putting.

Thus, it is clear that putter training devices of the prior art do not provide for consistent and proper training and are awkward to use, require assembly and adjustment each time the devices are used anew, or require extensive practice to use the training devices properly.

It is therefore an object of the present invention to provide for a putting training device that is light weight and does not significantly alter the feel of the putting stroke due to the additional weight and site of attachment on the putter, is easy to install, and minimizes any learning curve necessary to master the use of the device;

It is another object of the present invention to provide for a putting training device that provides visual feedback during all phases of a golf stroke without causing the golfer to lose actual visual contact with the ball;

It is yet another object of the present invention to provide for a putting training device which is easily adjustable and allows golfers of various heights and postures, and with various types of putters, to use the device and achieve the same benefits in putting assistance.

It is still another object of the present invention to provide for a putting training device which is simple to use and inexpensive to manufacture.

SUMMARY OF THE INVENTION

The present invention pertains to a putting training device which is preferably attached to a putter along the lower part of the grip. One side of the device has a long straight edge which extends out from the shaft a predetermined distance. The user of the device, at address, stands over a golf ball holding the grip of the putter, and visually aligns the straight edge so that the user sees the edge "touching" the heel of the putter and positioned normal to the striking surface of the putter, i.e., the putter face. The user then sees a highly visible "spacing" between the ball and the edge. The straight edge is long enough so that when the user takes a "normal" back swing, approach, and follow through swing, the edge and ball continually form or define a constant "spacing" as seen by the user. That is, the spacing does not change throughout all components of the swing. A normal swing for a properly executed putt of less than about 30 feet in length does not generally require the putter head to move more than about 5 to 7 inches from the ball. If the user executes a proper back swing, approach swing, and follow through swing, the spacing will not change. In other words, the edge will be seen by the user to move along a path parallel to the target line. An improper swing will cause the spacing either to increase or decrease, indicating the swing is not being executed along the parallel path. Thus, the user will practice with the device, actually seeing and experiencing the feel of a correct putting stroke, thereby shortening the time required to develop the proper feel to the point where the proper putting stroke can be carried over to actual play.

DESCRIPTION OF THE DRAWING

FIG. 4(*b*) is a view like FIG. 4(*a*) except the putter is at the apex of its back swing with the long straight edge of the device still "touching" the heel of the putter and parallel to the target line;

FIG. 4(*c*) is a view like FIG. 4(*a*) except the putter has impacted the golf ball and is in its follow through swing with the long straight edge of the device still "touching" the heel of the putter and positioned parallel to the target line;

DETAILED DESCRIPTION OF THE PREFERRED EMBODIMENT

Figure 1:
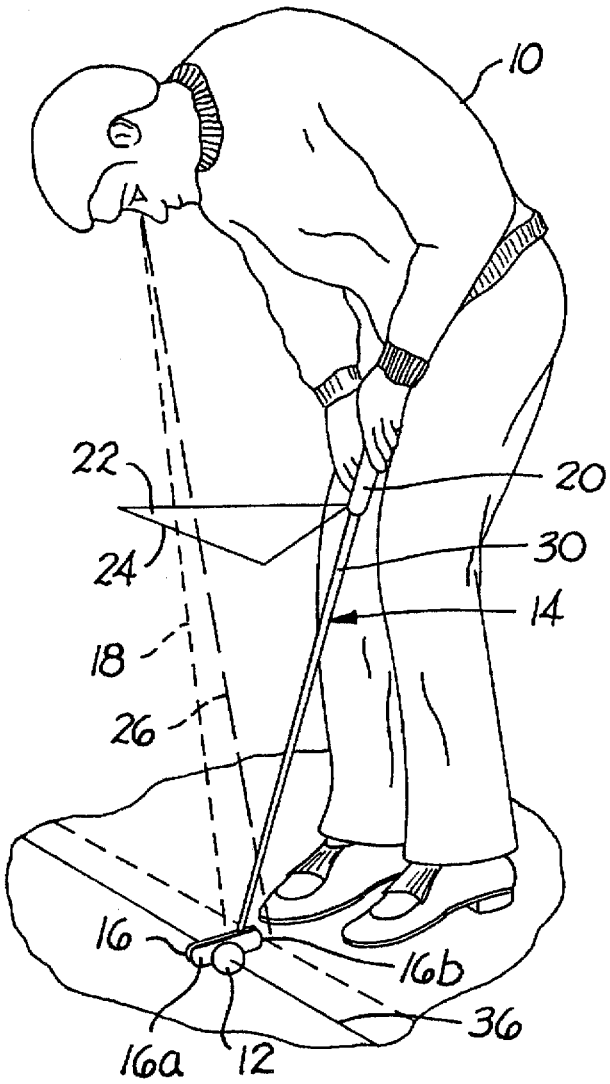
FIG. 1 is a perspective view of a user practicing a putting stroke using the putting training device of the present invention.

In the view of FIG. 1, a user, shown generally by the character numeral 10, is addressing a golf ball 12 with a putter 14. The face 16*a* of the putter head 16 is positioned normal to the desired path, i.e., target line 36, of the ball upon impact. The user 10 is positioned so that the he or she is looking straight down at the ball 12 where it essentially abuts the midpoint of the putter face 16*a* along line of sight 18 (depicted in dashed lines). Attached to the lower portion of the putter grip 20 is a putter training device 22 made in accordance with the present invention. Device 22 has a triangular shape in top view and is positioned on the grip 20 such that, when viewing along the long outer edge 24, the user 10 sees down a line of sight 26 (depicted in dashed lines) that the heel 16*b* of the putter head 16 "touches" and is aligned along the edge 24 of the device 22 and that edge 24 is normal to the putter face 16*a* and thus is parallel to the target line 36.

Figure 3:
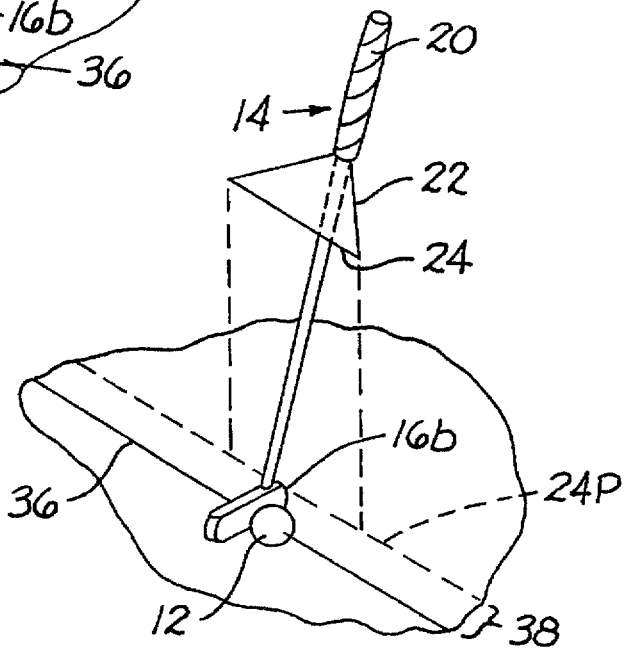
FIG. 3 is a perspective view of a putter with the putting device of the present invention attached thereto showing the plane of view of the user when the device is properly aligned.
Figure 2:
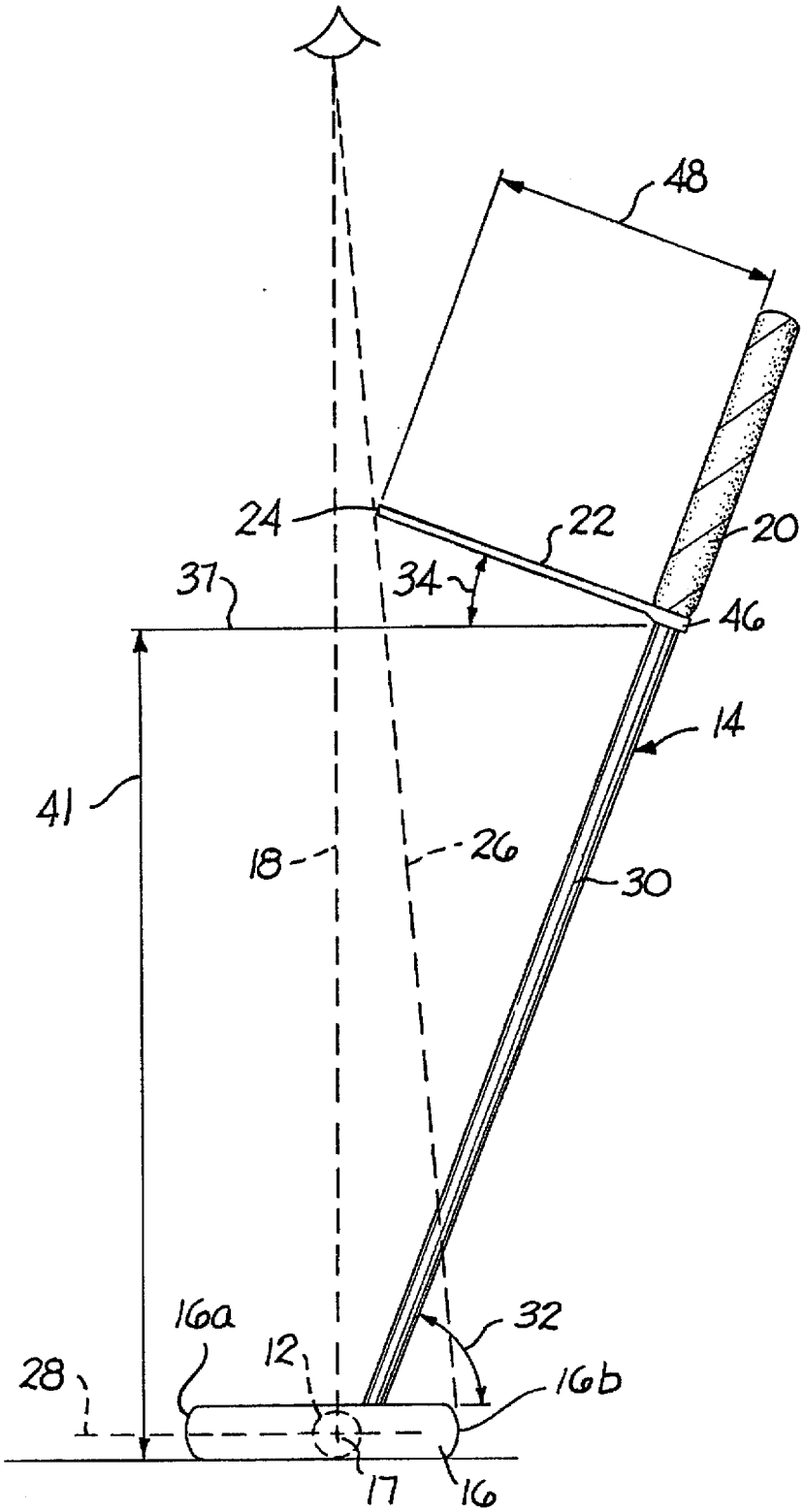
FIG. 2 is a side view of a putter with the putting training device of the present invention attached thereto.

As best seen in FIG. 2, the longitudinal axis 28 of the putter head 16 is at an angle 32 to the putter shaft 30. Preferably, the device 22 is attached to grip 20 and extends out from shaft 30 as shown in FIG. 2 and thus is at an angle 34 with the horizontal plane shown by dashed line 37. In the preferred embodiment, angle 34 may be anywhere from about 0° (device 22 in the horizontal plane 37) up to about 20° in which position the plane of device 22 is essentially normal to the axis of shaft 30. Thus, as portrayed in FIGS. 3 and 4(*a*), the user at proper address aligns the long straight edge parallel to target line 36 of the ball 12 and sees edge 24 extending a significant distance toward the direction of the intended ball movement and to the rear of ball 12. The length of edge 24 is sufficient to be visualized by the user as being adjacent the ball 12 during the entire putting stroke. As is well understood, it is much easier and more accurate to optically align a long straight edge in an accurate parallel relationship with another line, i.e., the target line 36, than to align a shorter line that approaches the diameter of the ball 12 in magnitude. It should also be noted that, because of its significant length, the edge 24 will be visible to the user looking straight down at ball 12 during the entire putting stroke for normal putts not exceeding about 30 feet.

Figure 4A:
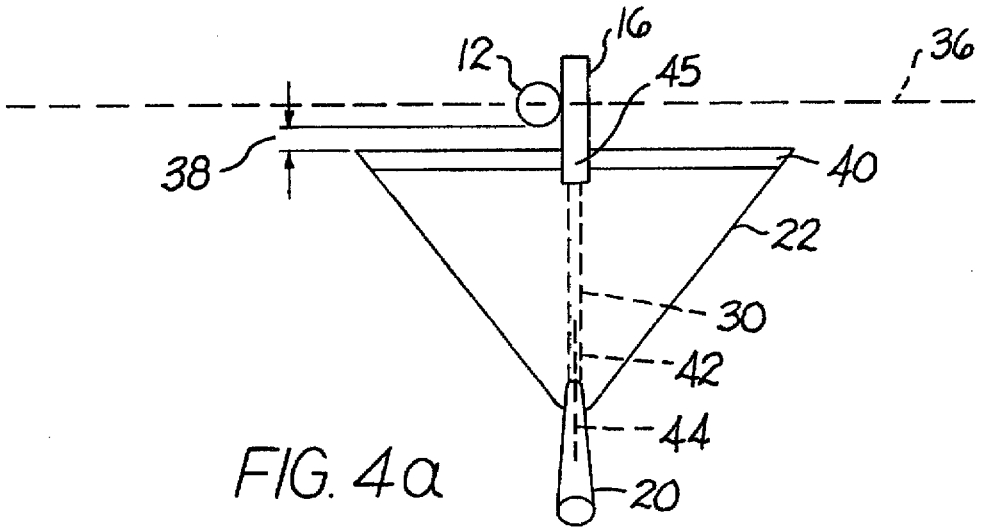
FIG. 4(*a*) is a top view as viewed by the user of the device when the golf ball is being properly addressed by the user showing the long straight edge of the device "touching" the heel of the putter and positioned parallel to the target line.
Figure 4B:
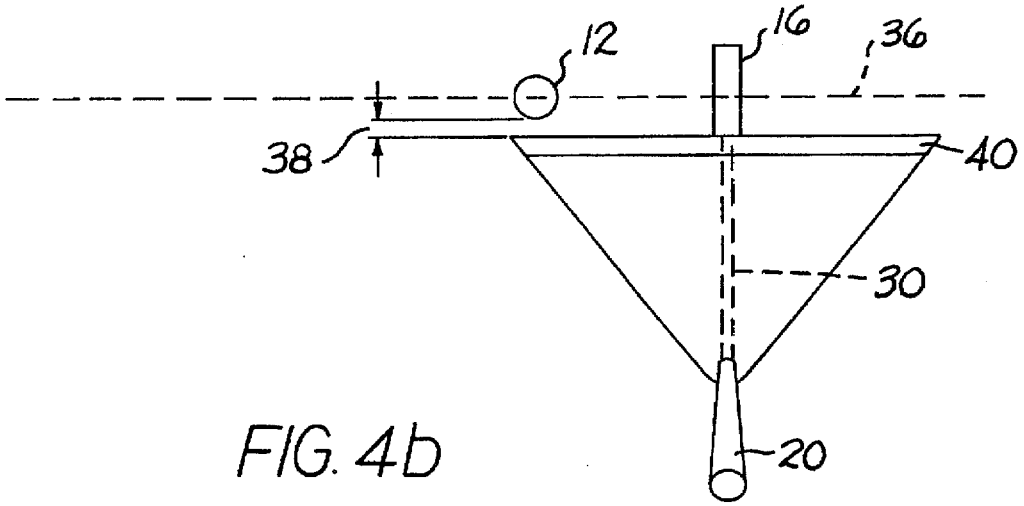
Figure 4C:
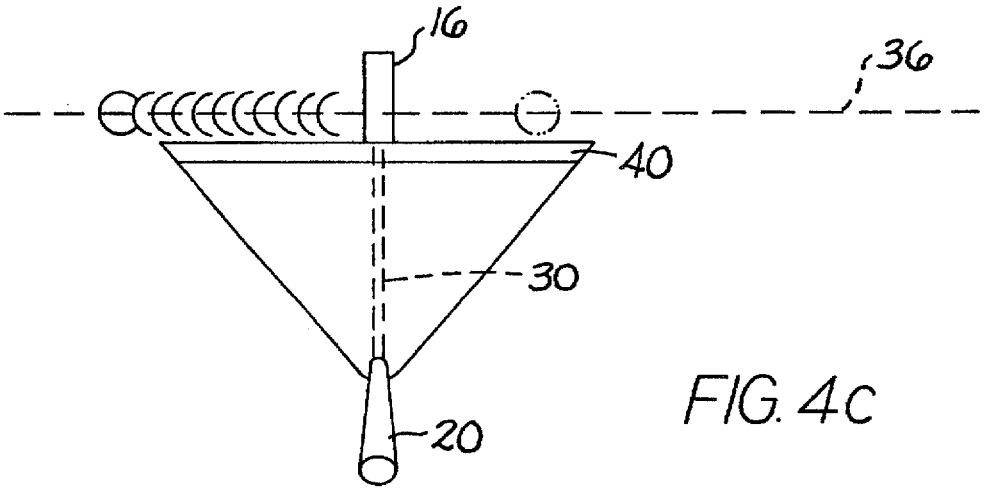

At address with the edge 24 properly aligned, the user will notice a horizontally measured spacing 38 between the edge of ball 12 and the edge 24. This spacing 38 is essentially the distance from the edge of the golf ball nearest the user to the projection line 24*p* of the long straight edge 24 when the putter is properly addressing the golf ball with device 22. When the user uses a proper putting stroke, spacing 38 should remain constant throughout the entire putting stroke. Because of the significant length of edge 24 with respect to the diameter of the ball 12, it is visually easy for a user to determine if the spacing 38 changes during the putting stroke. Moreover, because the device 22 is located nearer the user's eyes than it is to the putter head 16, any changes in spacing 38 are more easily detected due to the greater parallax between edge 24 and ball 12. As illustrated in FIGS. 4(*a*)–4(*c*), the long straight edge 24 is visually in close proximity to the ball 12 at all times during a normal putting stroke so that spacing 38 is always observed by the user, thus eliminating a tendency of the user to quickly glance away from the ball to determine if a change has occurred in the spacing. When the proper putting stroke is taken, spacing 38 should not change irrespective of the location along the target line 36 of the putter head 16. Because spacing 38 has not changed in FIGS. 4(*a*)–4(*c*) showing the movement of a putter during the back swing and approach, it is clear that the mid-point 17 of putter head 16 (shown in FIG. 2) has been moved along a path coinciding with the target line 36 of the golf ball 12 while maintaining the putter face 16*a* normal to the target line 36. While any change in spacing 38 during the putting stroke would be easily seen by the user, a stripe 40 of contrasting color to the background of the spacing may be placed adjacent the edge 24 to enhance the visibility of the spacing 38.

Figure 5A:
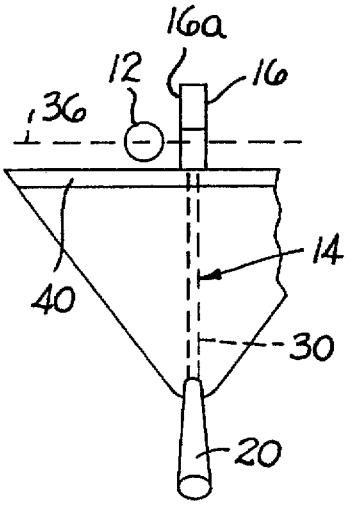
FIGS. 5(*a*) through 5(*c*) are top views like FIG. 4(*a*) showing a progressive sequence from address through the back swing in which the long straight edge of the device is improperly aligned with the target line and the spacing changes, indicating a putting stroke during which the mid-point of the putter face does not maintain the desired normal orientation with respect to the target line.
Figure 5B:
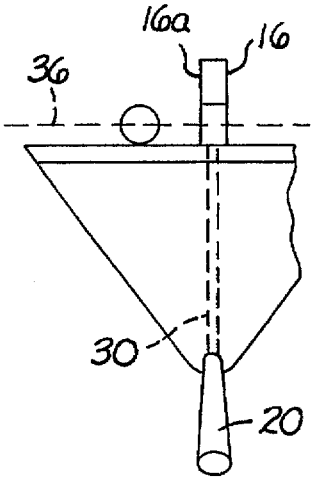
Figure 5C:
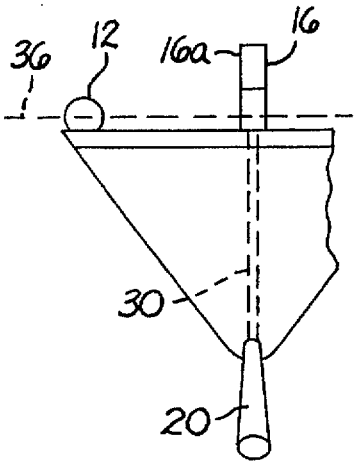

Illustrating an incorrect putting swing, FIGS. 5(*a*)–5(*c*) depict a change in the spacing 38 during the back swing. In this instance, the putter head 16 is being drawn back in a direction outside of the target line 36, a common error in putting, causing the spacing 38 to progressively diminish. Bringing the putter forward to impact would result in the ball 12 being propelled off the heel of the putter along a line to the left of the target line 36. The user, however, realizing the error from the change in spacing 38 would make an instant correction and continually repeat the putting stroke to ensure constant spacing during the entire stroke. Continued practice with device 22 to maintain the constant spacing 38 assists the user in developing the feel of a proper putting stroke to the point that the feel can be carried over into actual play.

Figure 6:
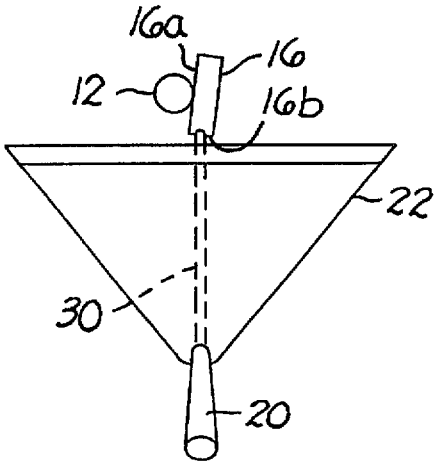
FIG. 6 is a top view like FIG. 4(*a*) depicting the long straight edge of the device not being properly aligned with the target line and normal to the putter face.

In most instances, it will be apparent to the user whether or not device 22 is correctly aligned with the shaft 30. At address, the edge 24 of device 22 should be aligned in a visually "touching" relationship to the putter heel 16*b* and normal to the putter head face 16*a* as shown in FIG. 4(*a*). An incorrect alignment is illustrated in FIG. 6 and should be contrasted to the correct alignment of FIG. 4(*a*). If desired, and as shown in FIG. 4(*a*), the putter grip 20 may be supplied with a visible marking line 44 which, if extended down the shaft 30, would bisect putter head 16 at its long axis essentially at its midpoint and the device 22 supplied with a visible marking line 42 essentially along the central axis thereof. When the device 22 is attached to the grip 20, it may be rotated until the two lines 42 and 44 are aligned. The alignment of lines 42 and 44 ensures that the device 22 is positioned such that edge 24 will be normal to the putter face 16*a* when the user is at address. In addition, a linear decal 45, as shown in FIG. 4(*a*), may be attached to the top surface of device 22, oriented normal to the long straight edge 24, and positioned in line with putter head 16. This in line relationship can be maintained throughout the putting stroke only when there is no wrist break, a desirable aspect of the pendulum stroke technique.

As stated before, it is desirable that attachment 46 for device 22 be located a distance above the putting surface, sufficient to promote a significant parallax relationship, so that minor movement of the putter head from the desired line of the putting stroke will be readily apparent to the user. It has been determined that attachment point 46 should be located above the midpoint of the putter 14, preferably a distance no less than about 20 inches from the putter head as measured along the shaft 30, although the exact distance will vary with the overall length of the putter 14. This preferred positioning of attachment point 46 would typically place device 22 along the lower end of the grip on most putters. Preferably, device 22 should extend outwardly from the putter grip 20 a distance 48 of between about 3 to 7 inches while the long straight edge 24 should be between about 6 to 14 inches in length.

Figure 7:
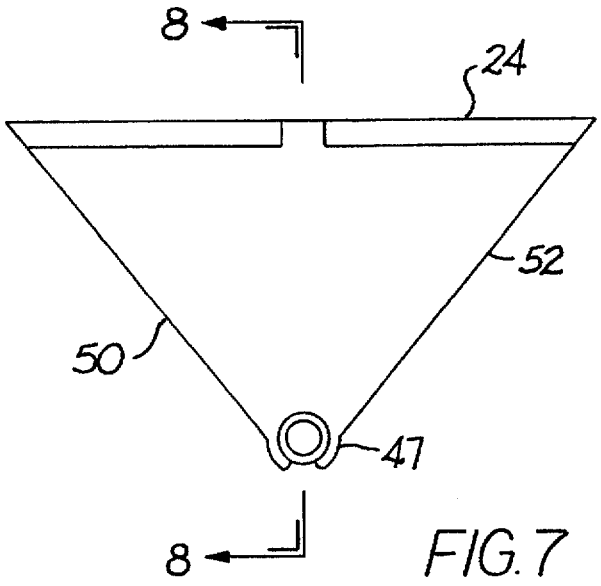
FIG. 7 is a top view of the device showing the snap connection to the grip of the putter and a visually enhancing border stripe.
Figure 8:
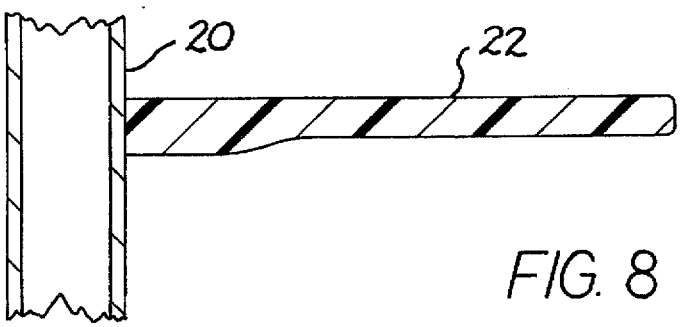
FIG. 8 is a sectional view taken along lines 8—8 of FIG. 7.

Any appropriate structure may be used to secure device 22 to the putter 14, preferably along the bottom portion of grip 20, so that the device can be aligned properly with respect to face 16*a* of the putter head 16. An example of the structure of securing device 22 to the grip 20 is illustrated in FIGS. 7 and 8. The sides 50 and 52 of device 22 converge to a snap lock channel 47 that flexes over grip 20 and tightly secures device 22 to putter 14. However, device 22 may still be rotated with respect to the shaft 30 as is preferred. Attachment of device 22 to the grip in this manner also allows for simpler construction. Such structure includes the use of certain plastic materials having a low coefficient of friction and which would otherwise slip if attached to the smooth surface of shaft 30. Additionally, the integral construction allows for simpler manufacture, installation on the putter, and use.

Because the device 22 is located high on the putter, preferably higher than the midpoint of the putter 14, thus closer to the hands of the user than to the putter head 16, the undesirable higher swing weight of a device located near the head of the putter, as is typical with other prior art putter training devices, is eliminated. This positioning is highly desirable, since changes in swing weight from practice to actual play can detrimentally affect the consistency of the "feel" for proper putting that must be carried over. By fabricating the device 22 from light weight, but durable materials, the weight change is made minimal, further ensuring the feel is consistent.

Figure 9:
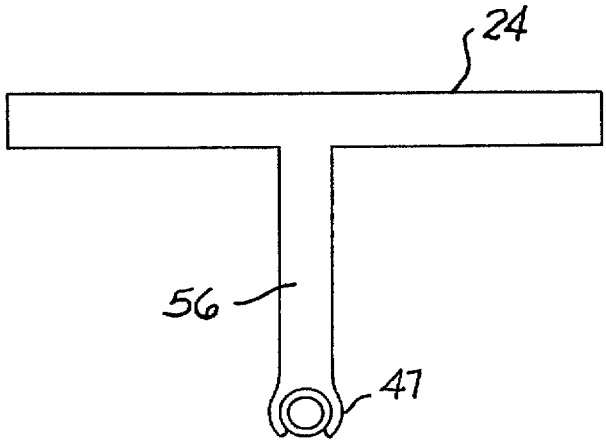
FIG. 9 is a top view of an alternate construction of the device of the present invention.

An alternate embodiment of device 22 is illustrated in FIG. 9 showing a putting training device of the present invention having a unitary structure and a T-shaped configuration in top elevation. The stem 56 connects the edge 24 to the snap lock channel 47. The alternate embodiment of device 22 may be more appealing to a user who would prefer that less vision be blocked. However, more vision may more distracting to some users during practice. Additionally, the alternate embodiment uses less material needed for manufacture.

From the above, it is understood that through practice with present invention, a user will experience instant visual feedback while putting, allowing the user to determine if the stroke is being properly executed and to focus more on the feel of a proper stroke. Additionally, the device is light weight and is attached to the club at an elevated height, thus eliminating an undesired weight added near the putter head and interfering with the development of a proper feel for putting that can be carried over into actual practice. Modifications and changes will become evident to one with ordinary skill in the art following a reading of the description herein taken with the drawings. Therefore, it should be further understood that in light of a reading of the foregoing description and drawings that those with ordinary skill in the art will be able to make such changes and modifications to the present invention without departing from the spirit or scope of the invention as defined in the following appended claims.

I claim:

1. In combination, a golf putting training device and a putter, said device and putter being used together to train a user to accurately putt a golf ball on a putting surface along a golf putting target line, said device further being a unitary, substantially planar member releasably secured to a shaft of said putter at a point along a lower edge of a grip of said putter, said member having a shaft connecting portion and an edge defining portion defining a straight edge, said shaft connecting portion extending from said point away from a user holding the putter to said edge defining portion a distance sufficient to permit said straight edge to be visually aligned by a user so that said edge visually touches a heel of a putter head of the putter addressing the golf ball and extends both forward of and behind said heel in a direction substantially parallel to said target line when (a) said member is secured to said shaft and said shaft is being gripped by the user and (b) the user's visual alignment to the golf ball on the putting surface as defined by a line extending from the user's eyes to the golf ball is essentially vertical, said straight edge having front and back ends spaced apart a distance sufficient such that when (i) said connecting member is secured to said shaft a distance of no less than 20 inches from said putter head as measured along said shaft and (ii) the user's visual alignment with the golf ball is essentially vertical, said user's visual alignment does not extend in front of said front end when said putter is at the apex of a back swing and does not extend behind said back end when said putter is at the apex of a follow through swing.

2. The training device of claim 1 in which said straight edge is between 6 to 14 inches in length between said front and back ends.

3. The training device of claim 1 in which said member has an orientation from a position substantially in the horizontal plane to a position substantially normal to said shaft.

4. The training device of claim 1 including a stripe positioned along said edge.

5. The device of claim 1 in which said device has a triangular shaped section in top view, said edge comprising one of three sides of said device.

6. The device of claim 5 in which said triangular shaped section has a fastener element positioned at a corner opposite said edge for securing said device to said shaft.

7. The device of claim 1 in which said device is substantially planar and has a T-shaped section in top view, said edge being the cross piece of said T-shaped section with a stem of said T-shape having a fastener element located at one distal end for securing said device to said shaft.

8. A combination putter and putter training device comprising a putter to assist a user to effectively and consistently putt a golf ball along a golf putting target line on a putting surface having (a) a shaft extending from a putter head at a predetermined angle to the vertical when said putter is placed in a "putting address" defined as a position said putter assumes when (i) the sole of said putter head is placed in a substantially abutting relationship with the putting surface and (ii) a golf ball striking surface of said putter head is positioned substantially vertically with respect to the putting surface and is placed in an essentially abutting relationship with the golf ball on the putting surface along a midpoint of said striking surface, and (b) a grip mounted adjacent the distal end of the shaft for gripping by a user, and a unitary training device having a substantially planar configuration and being releasably secured to said shaft at a predetermined distance above said putter head, said training device having a straight edge of a predetermined length and spaced from said shaft a distance sufficient to permit a user, who is (a) gripping the putter along said grip and (b) visually aligned essentially vertically over a golf ball when said putter head is in said putting address, to visually align said straight edge to be essentially parallel to the target line and and along a heel of the putter head extending both forward of and behind said heel whereby said edge and said golf ball collectively define a visual spacing therebetween at said putting address.

9. The combination of claim 8 including a stripe of color positioned along said straight edge.

10. The combination of claim 8 in which said device is secured to said shaft along a lower edge of a grip adapted to be gripped by a user.

11. The combination of claim 8 in which said device has a triangular shaped section in top view, said edge comprising one of three sides of said device.

12. The combination of claim 11 in which said triangular shaped section has a fastener element positioned at a corner opposite said edge for securing said device to said shaft.

13. The combination of claim 8 in which said device has a T-shaped section in top view, said edge being the cross piece of said T-shaped section with a stem of said T-shape having a fastener element located at one distal end for securing said device to said shaft.

14. The combination of claim 8 in which said device has a straight edge sufficiently long as to collectively define said spacing with said golf ball during both back swing and follow through.

15. The combination of claim 14 in which the straight edge is between 6 inches and 14 inches in length and is spaced from said shaft a distance of between 3 inches to 7 inches.

* * * * *